US006764359B2

(12) United States Patent
McCafferty

(10) Patent No.: US 6,764,359 B2
(45) Date of Patent: Jul. 20, 2004

(54) MARINE OUTDRIVE ASSEMBLY

(76) Inventor: Patrick F. McCafferty, P.O. Box 987, Silverton, OR (US) 97381

( * ) Notice: Subject to any disclaimer, the term of this patent is extended or adjusted under 35 U.S.C. 154(b) by 0 days.

(21) Appl. No.: 10/231,273

(22) Filed: Aug. 29, 2002

(65) Prior Publication Data

US 2004/0043678 A1 Mar. 4, 2004

(51) Int. Cl.[7] ..... B63H 1/14
(52) U.S. Cl. ..... 440/49
(58) Field of Search ..... 440/3, 113, 900, 440/49

(56) References Cited

U.S. PATENT DOCUMENTS 4,752,256 A 6/1988 Dorion
4,976,637 A 12/1990 Newell et al.
5,083,948 A 1/1992 Grobson
5,405,277 A 4/1995 Stalker
5,413,511 A 5/1995 Hawkenson
5,643,024 A 7/1997 Roberson, Jr.

FOREIGN PATENT DOCUMENTS

IT 653895 * 5/1963 ..... 440/900
JP 2001-115814 * 4/2001

* cited by examiner

*Primary Examiner*—Jesus D. Sotelo
(74) *Attorney, Agent, or Firm*—Carl D. Crowell

(57) ABSTRACT

An apparatus for use with a vertical shaft lawnmower motor to provide an outboard motor for boat propulsion. The apparatus is comprised generally of a light weight drive housing adapted for a motor to be mounted on one end, and a drive shaft longitudinally disposed through said drive housing with a gear carrier and propeller mounted on the other end of the drive housing. The lower end of said drive housing having an oval gear seat for mounting the gear carrier, propeller shaft and propeller.

1 Claim, 2 Drawing Sheets

MARINE OUTDRIVE ASSEMBLY

BACKGROUND OF THE INVENTION

1. Field of the Invention

The present invention relates in general to marine outdrives of the type used to propel small boats through the water, and more particularly to a marine outdrive apparatus for use with a gasoline powered motor of the type commonly found on lawnmowers.

2. Prior Art

Lawnmowers are a common household appliance utilized in many homes. The motors to power lawnmowers are plentiful and inexpensive. The purpose of this invention is to allow convenient conversion of a vertical shaft lawnmower motor into a marine outboard motor.

Prior art includes U.S. Pat. No. 5,405,277 for adaptation of a line trimmer into a boat motor. The '277 patent is for utilization of the louder, lower power and more polluting two-stroke line trimmer engines. These types of engines are not permitted in environmentally sensitive areas. The small displacement line trimmer engines of the '277 patent also tend to run at speeds far higher than would be optimal for use in the marine environment. To permit efficient use, the smaller two-stroke engines need a costly gear reduction. Smaller two stroke engines generally run at 6,500–7,500 RPM, far above the desirable RPM for normal boat propulsion. Without the addition of a gear reduction, the result is that there are dangerous loads placed on drive components leading to excessive wear and component failure.

U.S. Pat. No. 4,976,637 for conversion of a line trimmer to an outboard motor; and an adapter plate. The '637 patent also provides for use of the less desirable high RPM two-stroke engines with many of the same faults as the '277 patent.

U.S. Pat. No. 5,643,024 allows for the attachment of a four cycle internal combustion vertical shaft motor to an outdrive marine unit. Most pre-existing vertical shafts for use with outdrive motors are right hand rotation. Most small engines such as those used in lawnmowers are left hand rotation, making a simple adapter plate unsuitable for use with the majority of small displacement engines available. In addition, most outboard marine units are geared to an engine RPM range of 4,000 to 5,500 making the outdrive component undesirable for use with small engines of the lawnmower type which generally operate in the 2,400 to 2,800 RPM range.

The prior art is for the use of low power two-stroke engines commonly found in line trimmers, which are highly polluting and prohibited in many areas. The adapter plate disclosed requires that a vertical shaft element of a traditional marine motor be used, often being heavier than necessary and missing elements for optimal use with a lawnmower type engine.

As can be seen a need exists for a single outdrive assembly for use with readily available small four stroke engines of the 3 to 6½ horsepower range. Such invention is below described and claimed.

BRIEF SUMMARY OF THE INVENTION

Briefly, there is provided with the present invention a new and improved apparatus to convert a lawnmower motor to an outboard motor.

In the preferred embodiment, preferably a 3 to 6½ horsepower vertical shaft lawnmower motor is attached to a tubular drive housing. The vertical shaft of the motor is attached by an adapter collet to a vertical drive shaft that resides in the housing. This is facilitated by industry standards for this type of vertical shaft engine. The Society of Automotive Engineers (SAE) has issued standards for two and four stroke vertical shaft engines of 6 horsepower and under, commonly known as the SAE j609 standard. This standard provides a uniform mounting of the drive shaft housing and drive shaft of the invention for the majority of engines suitable for use with the invention. The ready adaptability of this standard to the present invention should not be considered limiting, but simply demonstrative of the high degree of utility.

The upper end of the drive housing is preferably a bell type housing. This permits the ready mounting of small displacement engines with an extended motor shaft similar to the SAE j609 standard. The available space also permits the accommodation of protrusions on the mounting face of many engines, such as oil pan plugs, and the room to incorporate a centrifugal clutch with the adapter collet coupling the motor shaft to the drive shaft.

At the lower end of the drive housing is attached the gear carrier, propeller shaft and propeller. A lower opening in the housing is open at approximately a 90 degree angle from the drive shaft. In the preferred embodiment this opening is a non-circular ovoid. The gear carrier is also of an ovoid design, which provides for automatic alignment of the drive shaft to the gear carrier and propeller.

Displaced along the trailing edge of the drive housing is a skeg or rudder flange, and located at the end proximate the engine mount is a tiller for ease in providing directional control.

The use of standard four-cycle vertical shaft engines is particularly advantageous, as they are environmentally superior to two-stroke engines commonly found on smaller outboard drives and smaller engines of the line trimmer and chainsaw variety. Four-cycle engines do not burn and eject oil into the environment at the levels of two-stroke engines. Small vertical shaft four-cycle engines are also more commonly and readily equipped with mufflers reducing noise pollution.

Other elements provided to facilitate use include a transom mount and drive mount with a supporting saddle.

Due to the nature of the invention, traditional metal materials may be used to fabricate the components, or in the alternative the drive housing and significant other components may be made from synthetic materials such as plastic formed in an injection mold, saving production costs and time.

With the simplicity of limited number of parts, end users will be able to assemble, repair and maintain the invention with minimal skill, making the device lower in cost to maintain.

Accordingly, the objects and advantages of the present invention include: to provide an adapter that will allow for an alternative use of readily available inexpensive lawnmower motors; to provide an outboard motor device which can be an economic alternative to the purchase of an outboard motor; to provide a low cost alternative to two stroke marine outboard motors; to provide a low cost environmentally superior low power outboard drive; and to provide an outboard motor device that is light and easy to manage and maintain.

BRIEF DESCRIPTION OF THE SEVERAL VIEWS OF THE DRAWING

In the drawings, like elements have the same number throughout the views.

DETAILED DESCRIPTION OF INVENTION

Figure 1:
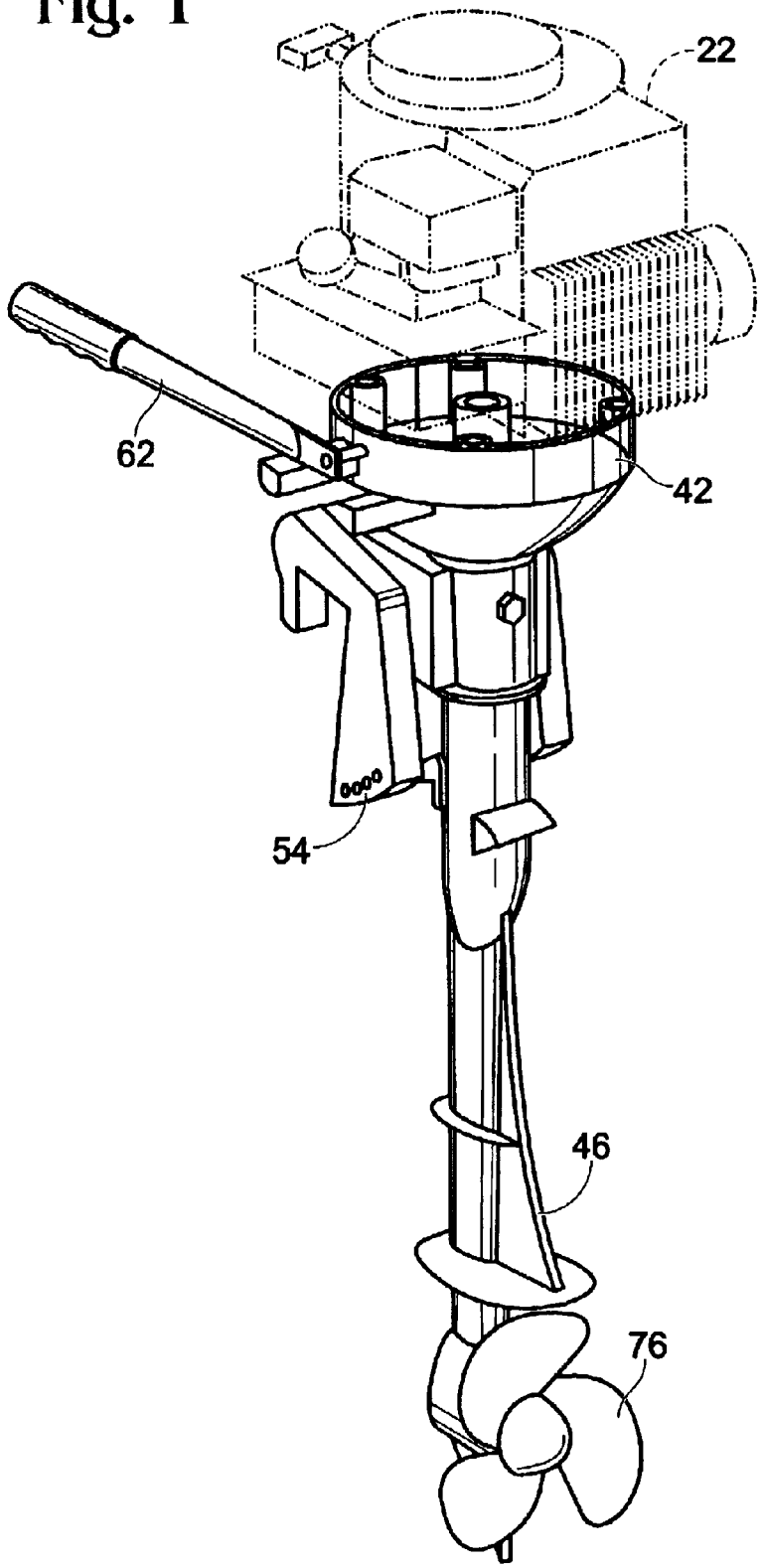
FIG. 1 is a perspective view of the invention with a mounted motor indicated.

In the preferred embodiment a motor shaft 24 from a conventional vertical shaft small motor 22, which is preferably 3 to 6½ horsepower, is attached to one end of the drive shaft 40, which is positioned within the drive housing 42. To join the motor shaft 24 and the drive shaft 40 an adapter collet 30 is used, though a centrifugal clutch may also be used. A seal mount 32 is used to prevent water contamination of the system and to hold the drive shaft 40 in place. Bushings 34, 36 are used throughout the system. The motor 22 is attached to the drive housing 42 at one end adapted to readily receive small motors of the type commonly found in gasoline lawnmowers. In the preferred embodiment, mounting holes are available to receive inserts 44 in a standardized format such as the SAE j609 standard. The mounting bolts 20 are threaded to the inserts 44, which are received into the drive housing 42. Adapter rings, not shown, may be fitted to the drive housing 42 to permit use of motors with alternate mounting configurations.

The drive housing 42 itself, is such that it may be formed of a single piece through the use of machined solids, injection molding, lamination, casting or a combination of these or similar processes. Suitable materials include lightweight aluminum, metal alloys, various plastics and fiber composites. Placed along one side of the drive housing 42 is an elongated rudder flange 46 or skeg to assist with direction control.

Figure 2:
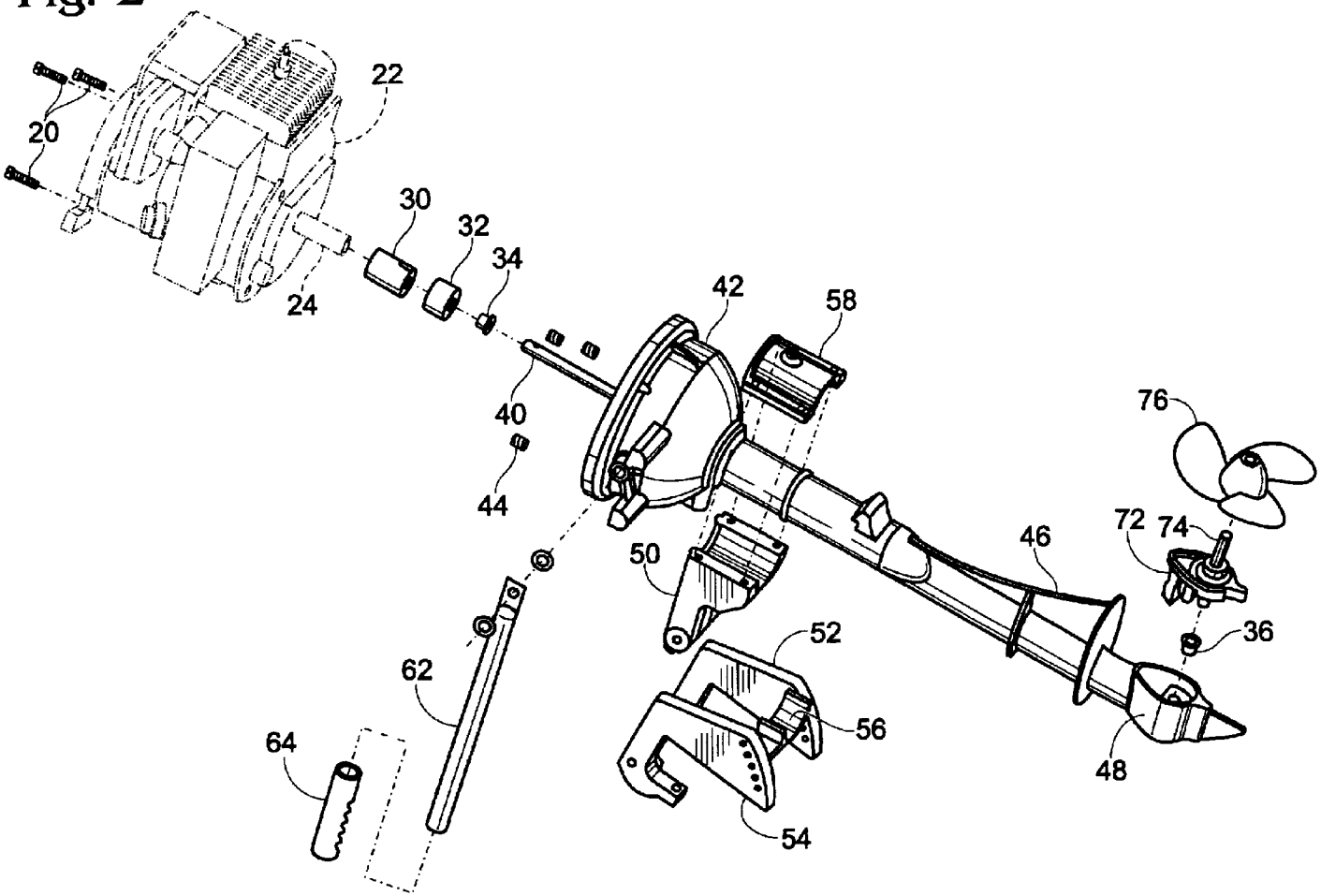
FIG. 2 shows an isometric exploded view of the adapter with the motor.

The drive housing mount 50, as shown in FIG. 2 is seated next to a vertical tubular portion of the drive housing 42 a short distance below the motor 22. The drive housing 42 is held in place by a clamp 58 or similar means.

A right transom mount 52 and a left transom mount 54, are pivotally affixed to the drive housing mount 50. The saddle 56 is disposed between the right transom mount 52 and the left transom mount 54 and receives the tubular portion of the drive housing 42 to provide additional support when the invention is under load.

A tiller 62 is affixed to the drive housing 42 a short distance below the motor 20. A grip 64 is affixed to the distal end of the tiller 62. Throttle controls (not shown) for the motor 22 may be affixed to the tiller 62.

At the lower portion of the drive housing 42 is attached the gear carrier 72, propeller shaft 74, and propeller 76. The drive shaft 40 extends to the ovoid opening or oval gear seat 48 at the lower portion of the drive housing 42. To the lower portion of the drive housing is mounted an additional bushing which the drive shaft 40 transits to provide stability for the drive shaft 40. Gears in a gear carrier 72 engage the lower portion of the drive shaft 40. The gear carrier 72 contains a series of gears to rotate the power output to a propeller shaft 74 which is affixed to a propeller 76. Additional bushings and seals 36 may be provided to prevent water or other contamination of the assembly. To facilitate construction and the alignment of components in assembly and repair, the gear carrier 72 matches in shape the oval gear seat to permit ready alignment of the elements on insertion of the gear carrier 72 into the oval gear seat 48.

Operation

A small 3 to 6½ horsepower motor is affixed to the invention as above described. The engine is started in a conventional manner, for example, pulling the starter cord. When the engine is running, the speed of the engine can be adjusted by standard throttle control mounted on the engine or tiller. The boat is steered by regular means, namely, rotating the unit by means of the tiller, which faces toward the interior of the boat. The drive housing 42 is readily rotateable within the drive housing mount 50 and clamp 58, which retains the drive housing. Additional support when under load is provided by the transom mount saddle 56.

While the present invention has been described in connection with a particular embodiment thereof, it will be understood by those skilled in the art that many changes may be made without departing from the true spirit and scope of the present invention. The true scope of the invention is intended to be limited only by the scope of the below claims.

I claim:

1. An apparatus to convert preferably a 3 to 6½ horsepower vertical shaft lawnmower motor into an outboard motor comprising:

a drive housing having a first end and a second end, said first end of said drive housing being adapted to receive a vertical shaft motor with a motor shaft, a drive shaft longitudinally disposed within said drive housing for being coupled to said motor shaft by a coupler, said second end of said drive housing having an opening, a gear carrier mounted in said opening and operatively coupled to said drive shaft; said opening and said gear carrier being non-circular, and a propeller attached to said gear carrier by a propeller shaft.

* * * * *